US005472779A

United States Patent [19]

Cann et al.

[11] Patent Number: 5,472,779

[45] Date of Patent: Dec. 5, 1995

[54] LOOSE FILL PACKING MATERIAL AND APPARATUS FOR MANUFACTURING SAME

[75] Inventors: Ronald Cann; Steve Cann, both of Pompano Beach; Robert Lee; Kevin J. Haggerty, both of Parkland, all of Fla.

[73] Assignee: Ecotone of Broward, Inc., Boca Raton, Fla.

[21] Appl. No.: 184,559

[22] Filed: Jan. 21, 1994

[51] Int. Cl.[6] ..... B32B 9/00

[52] U.S. Cl. ..... 428/357; 428/102; 428/174; 428/191; 428/194; 428/221; 428/402; 428/537.5; 428/905; 206/584; 206/814; 493/967

[58] Field of Search ..... 428/402, 357, 428/191, 102, 174, 194, 221, 537.5, 905; 206/584, 814; 493/967

[56] References Cited

U.S. PATENT DOCUMENTS 4,990,381 2/1991 Holzner ..... 428/35.3
5,312,665 5/1994 Pratt et al. ..... 428/402
5,330,819 7/1994 Kruoger ..... 428/102

*Primary Examiner*—Patrick J. Ryan
*Assistant Examiner*—Abraham Bahta
*Attorney, Agent, or Firm*—Holland & Knight

[57] ABSTRACT

This invention is directed to loose fill packing material comprising clean, elongated strips of paper formed from sheets of corrugated cardboard by an apparatus which comprises a shredder device operative to convert the sheets of corrugated cardboard into paper strips for discharge onto a perforated conveyor movable between a loading position at the shredder device and a discharge position where the paper strips are emptied into a collection hopper. A suction housing is mounted at the outlet of the shredder device in position to substantially enclose the conveyor so that a suction can be drawn over the paper strips to remove dirt, dust and other foreign materials therefrom after which the cleaned paper strips are transmitted by the conveyor to an angled sifter plate having a plurality of openings which are sized to allow undesired, short strips of paper to pass therethrough. A spraying device is provided to deposit a liquid material onto the paper strips having microbicidal, sanitizing, insect repellant, disinfectant and deodorizing properties.

4 Claims, 5 Drawing Sheets

LOOSE FILL PACKING MATERIAL AND APPARATUS FOR MANUFACTURING SAME

FIELD OF THE INVENTION

This invention relates to an apparatus for converting corrugated cardboard boxes into loose fill packing material comprising elongated strips of cardboard which are substantially free of dirt, dust and other contaminants, and, which are coated with a liquid material having microbicidal, sanitizing, insect repellant, disinfectant and deodorizing properties.

BACKGROUND OF THE INVENTION

A wide variety of items are shipped in containers which must be at least partially filled with packing material in order to prevent breakage or damage to such items. One of the most popular forms of packing material is formed of polystyrene or "Styrofoam" fabricated in a generally cylindrical shape, commonly known as a "peanut." In most instances, a layer of Styrofoam peanuts is first placed at the bottom of the container, the item to be shipped is positioned atop such layer and then additional Styrofoam peanuts are introduced into the container along the sides and top of the item to complete the packing operation.

One problem with the use of Styrofoam peanuts as loose fill packing material is that items tend to shift, settle or creep within the container in the course of shipment. It has been found that the Styrofoam peanuts tend to move relative to one another, and, in turn, permit movement of items they surround to the bottom or sides of the shipping container where damage to such items can occur.

This problem of shifting of items within a shipping container has been solved to some extent by the use of other packing materials in addition to or as a replacement for the Styrofoam peanuts. For example, a blow-in foam has been utilized with Styrofoam peanuts to enhance the shock absorbing and encapsulating properties of the packing material, but this adds substantial expense and time to the packing operation. Other packing materials such as "bubble-pack", i.e. sheets of plastic material having encapsulated pockets of air, have also been used as an addition to or substitute for Styrofoam peanuts. Unfortunately, bubble-pack is also expensive and can be difficult to work with depending upon the size, shape and/or weight of an item to be shipped.

Another problem with Styrofoam peanuts and other types of foam packing materials is that they promote the formation of static electricity within the shipping container. The presence of static electricity in packing materials can create substantial problems with sensitive electrical components. Additionally, electrostatically charged foam material tends to attract contaminants and other impurities which make their use in the shipment of food items and similar articles undesirable. Although the development of an electrostatic charge on Styrofoam peanuts and other types of foam packing materials can be reduced by the addition of an antistatic agent, the process of applying an antistatic agent to such packing materials is expensive both in terms of material cost and the labor required to apply the antistatic agent.

Styrofoam peanuts, blow-in foam, bubble-packaging and other types of plastic packing material all create a disposal problem and can be dangerous to the environment. Plastic materials are inert and do not biodegrade when placed in a landfill, and therefore take up a large quantity of space. Additionally, a chemical leaching can take place with certain types of plastics which creates environmental hazards such as pollution of groundwater supplies and other hazards. A number of states currently have legislation pending to reduce or eliminate the dumping of styrofoam products and other types of plastics within sanitary landfills and this could pose a significant disposal problem for companies employing loose fill material of this type or who receive products packaged in such material.

SUMMARY OF THE INVENTION

It is therefore among the objectives of this invention to provide a loose fill packing material which is environmentally safe, which is biodegradable, which is relatively economic, which does not promote the formation of static electricity, which exhibits good insulating properties, which is shock absorbing and which has superior encapsulating properties. Other objectives of this invention include the provision of an apparatus for manufacturing loose fill packing material which is simple and economical in operation, which eliminates dust, dirt and other contaminants from the packing material, which produces packing material of substantially uniform size and which applies a liquid treatment material to the packing material.

These objectives are accomplished in an apparatus for forming loose fill packing material which comprises a shredder device operative to convert sheets of corrugated cardboard into elongated, thin paper strips which are discharged onto a perforated conveyor movable between a loading position at the shredder device and a discharge position where the paper strips are emptied into a collection hopper. A suction housing is mounted at the outlet of the shredder device in position to substantially enclose the conveyor so that a suction can be drawn over the paper strips to remove dirt, dust and other foreign materials therefrom for deposit into a throwaway collector bag. After exiting the suction housing, the cleaned paper strips are transmitted by the conveyor to an angled sifter plate having a plurality of openings which are sized to allow undesired, short strips of paper to pass therethrough for deposit into a waste hopper. The remaining paper strips are discharged from the sifter plate into a collection hopper. Preferably, a spraying device is provided to deposit a liquid material onto the paper strips having microbicidal, sanitizing, insect repellant, disinfectant and deodorizing properties.

One aspect of this invention is predicated upon the concept of providing an efficient and economical apparatus for the formation of cleaned and sanitized paper material strips from sections or sheets of used corrugated, cardboard boxes which would otherwise be disposed of in a landfill or the like. The paper strips are formed by a commercially available shredder device, but are then treated in several respects before being suitable for use as packing material. In order to obtain "clean" paper strips, the suction housing is effective to remove dirt, dust and other contaminants from the paper strips as they exit the shredder device. In the event any short paper strips are formed in the shredding operation, such shorter strips are removed in the course of passage along the sifter plate. The remaining paper strips are then treated with a liquid having the properties noted above to further ensure that the packing material is clean and suitable for use with items of all types.

The loose fill packing material produced by the apparatus of this invention has a number of advantages over Styrofoam peanuts, blow-in foam materials, bubble-packaging and similar plastic packing materials. The paper strips formed by the apparatus herein are biodegradable and environmentally safe unlike Styrofoam peanuts and other types of plastic packaging materials which are inert, and are often subject to chemical leaching which can release dangerous chemicals to the environment. The paper strips herein are denser than the lightweight, Styrofoam peanuts currently used in many loose fill packaging applications which makes them easier to handle and collect, both during the packing operation and when the item is removed from the shipping container. The paper strips of this invention readily conform to the shape of the item being shipped and substantially resist shifting, settling or creeping of the item within the container in the course of shipment while providing superior insulation and shock absorption properties. Additionally, the paper strips herein formed from corrugated cardboard boxes do not promote the formation of an electrostatic charge and need no antistatic agents in order to safely ship sensitive electrical components and the like. Further, the overall cost of the paper strips of this invention is reduced compared to other loose fill packing material because it reduces breakage of the items shipped, it can be disposed of by the customer with normal cardboard disposal equipment or containers, and/or the paper strips can be reused in subsequent shipping applications.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
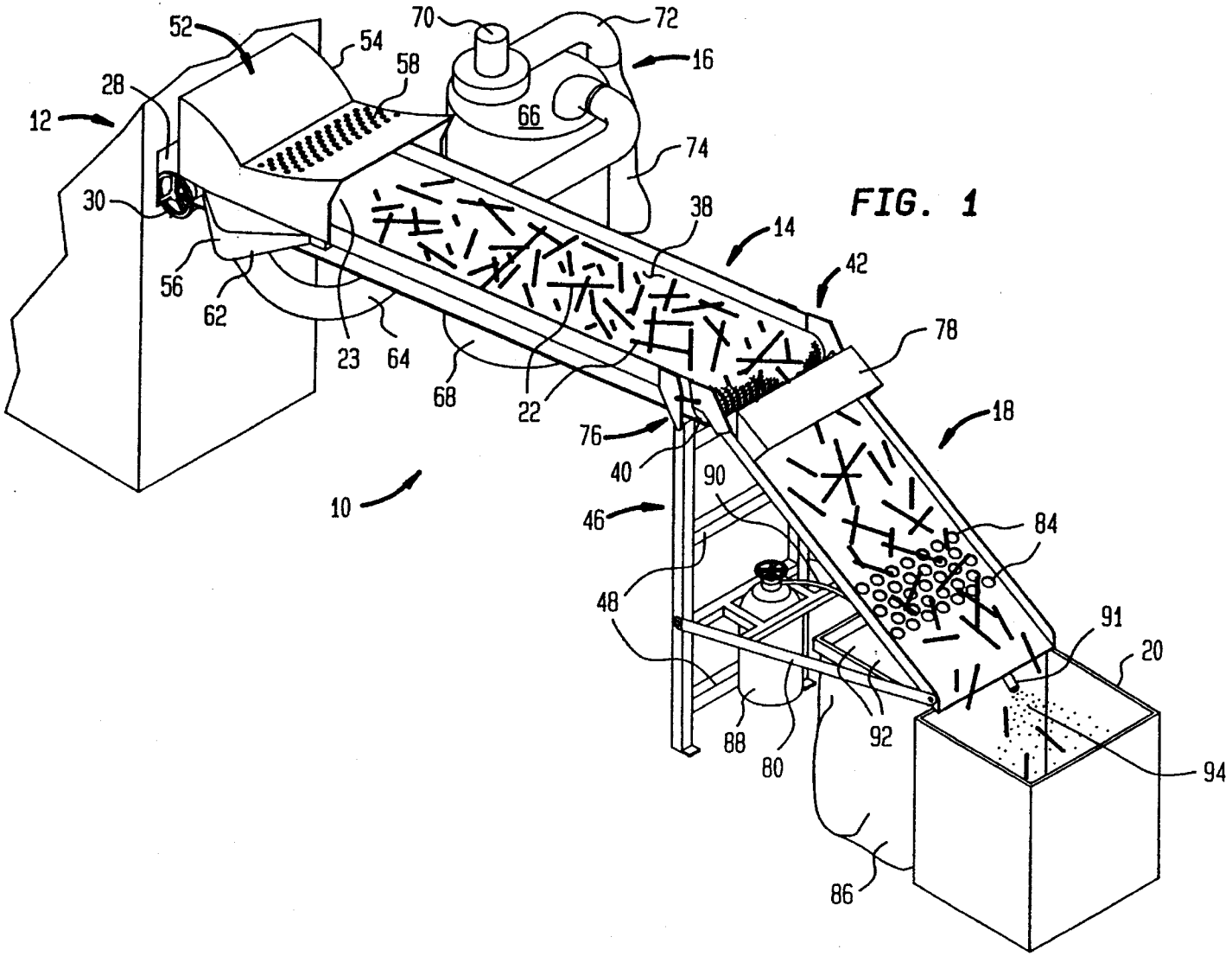
FIG. 1 is an overall perspective view of the apparatus of this invention.

Referring now to the Figs., the apparatus 10 of this invention comprises a shredder device 12, a conveyor 14, a suction device 16 and a sifter plate 18 which feeds a collection hopper 20. The various elements of apparatus 10 are discussed separately below, followed by a description of the operation of apparatus 10 in forming paper strips 22.

The detailed structure and operation of the shredder device 12 forms no part of this invention of itself and is therefore not discussed in detail herein. It is contemplated that shredders of the type sold by Industrial Shredder and Cutter Co. of Salem, Ohio, under Model No. 16 and/or 16B would be suitable for use in the apparatus 10 of this invention. Paper shredder devices 12 of this type include a paper inlet 24 which receives corrugated paper (not shown) in the form of sheets salvaged from used corrugated cardboard boxes or other sources of corrugated paper. The shredder device 12 is effective to cut or shred the corrugated paper into thin, elongated paper strips 22 preferably having a length in the range of about 2 to 14 inches and a width, in the range of about ⅛ to ¼ inches and preferably about ⅛ inch. The thickness of the paper strips 22 depends on the flute type of the corrugated cardboard being shredded, and it is contemplated that both single and double walled cardboard could be utilized to form paper strips 22, although triple wall cardboard may also be suitable. It should be understood that the length and width of the material strips 22 produced by shredder device 12 may vary with the type of shredder machine employed and the dimensions of the corrugated cardboard sheets. For example, the length of the paper strips 22 could be up to 24 inches, if desired. The above dimensions are therefore given by way of example of the normal or preferred size ranges of paper strips 22 but are not intended to be exhaustive of all possible sizes.

The shredder device 12 is formed with an outlet 28 from which the paper strips 22 are emitted and dumped onto the input end 23 of conveyor 14. In the presently preferred embodiment, the conveyor 14 includes a driven pulley 30 having a friction ring 32 which is drivingly connected to a drive pulley 34 associated with the shredder device 12. The drive pulley 34, in turn, is drivingly connected to a belt 33 and by a second belt 35 to another pulley 37 associated with shredder device 12. The driven pulley 30 is mounted to a drive roller 36 located at the outlet 28 to the shredder device 12. The drive roller 36 carries an endless, perforated belt 38 which is looped around an idler roller 40 located at the discharge end 42 of the conveyor 14. Preferably, the perforated belt 38 is at least partially enclosed along its side edges by a frame 44 which extends from the outlet 28 of suction device 16 to a vertically oriented support stand 46 located at the discharge end 42 of conveyor 14. The support stand 46 is provided with a number of steps or rungs 48 which are vertically spaced from one another and are adapted to releasably mount the discharge end 42 of conveyor 14. As a result, the conveyor 14 may be positioned at different angles in between the shredder device 12 and the support stand 46, as desired. In the position depicted in the Figs., the discharge end 42 of conveyor 14 is positioned vertically above its input end 23 14 which is connected to the shredder device 12.

Figure 2:
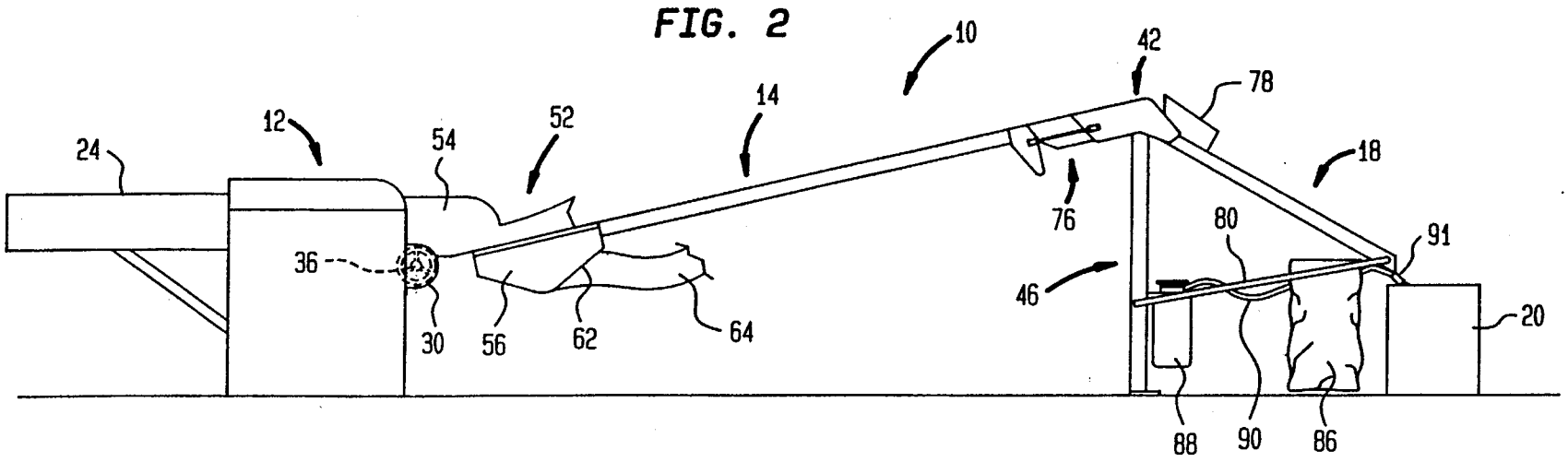
FIG. 2 is a side view of the apparatus depicted in FIG. 1.
Figure 3:
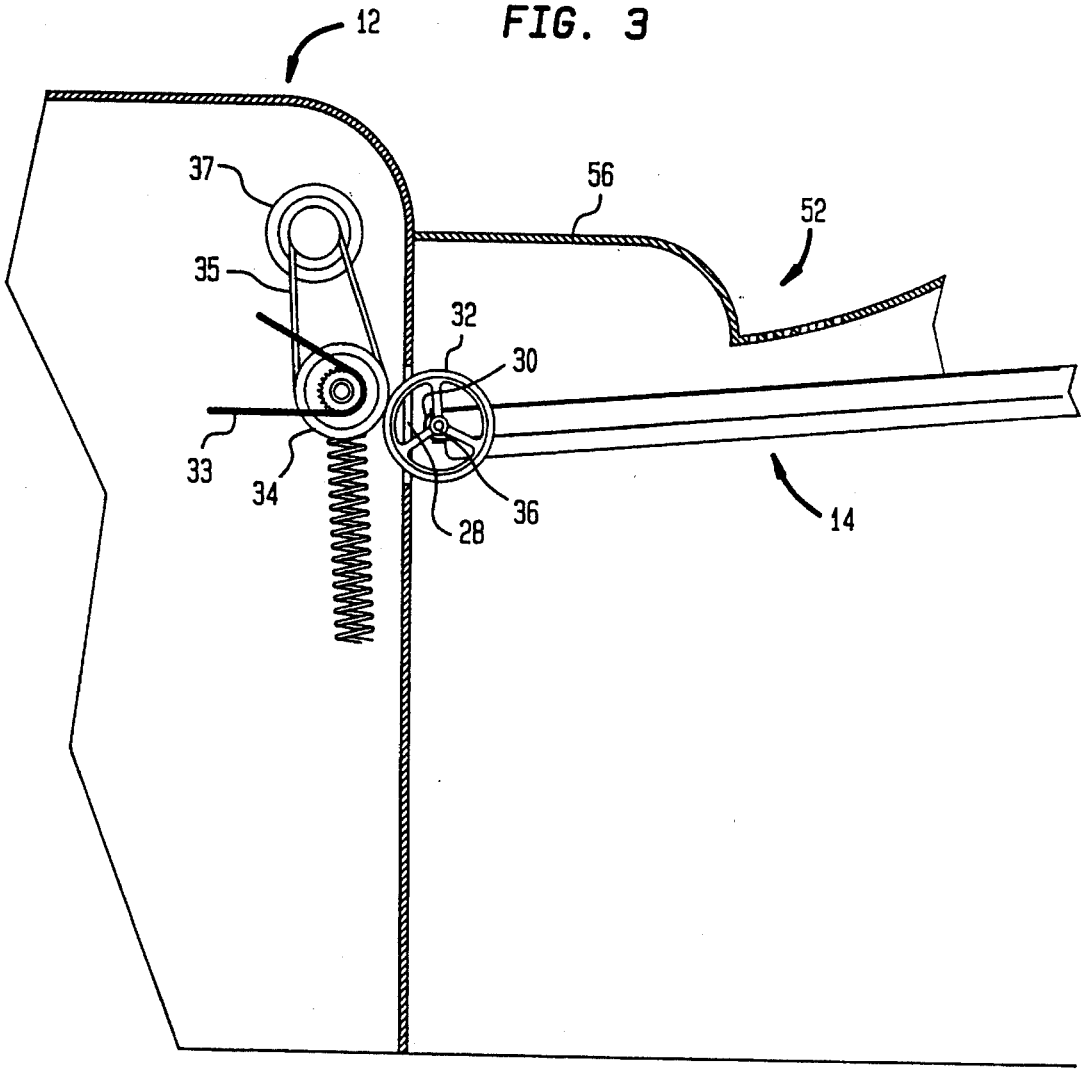
FIG. 3 is a view of the conveyor drive mechanism of this invention.
Figure 4:
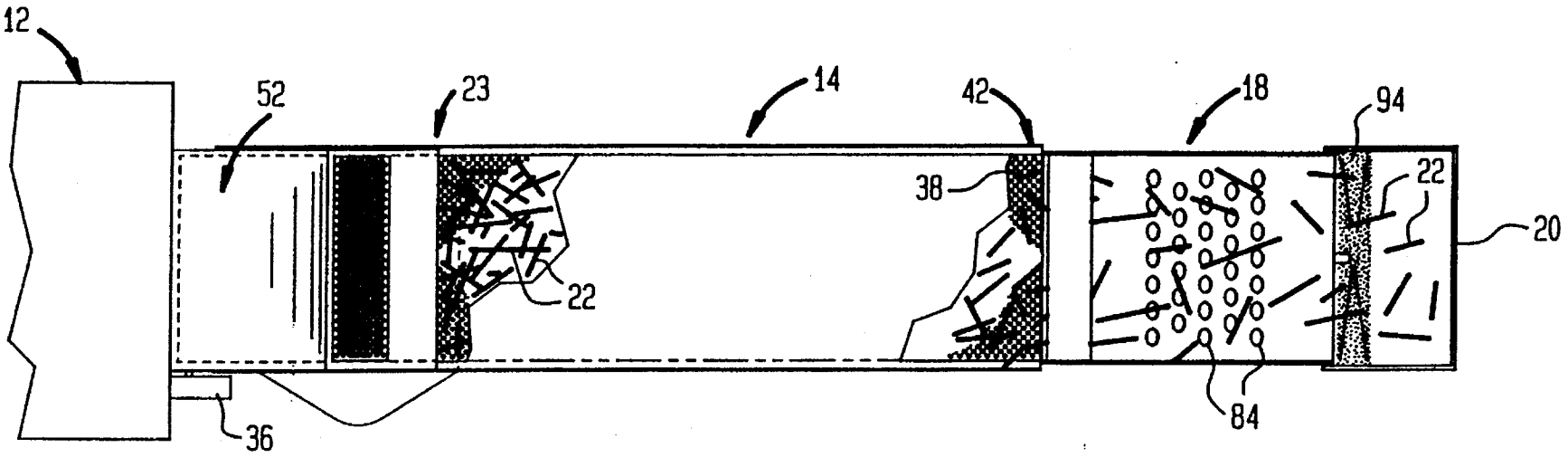
FIG. 4 is a plan view of the apparatus shown in FIG. 1.

As shown in FIGS. 1 and 2, the suction device 16 is located at the outlet 28 of shredder device 12 in a position to substantially enclose at least a portion of the perforated belt 38 of conveyor 14. The suction device 16 comprises a suction housing 52 having an upper portion 54 located atop the perforated belt 38, and a lower portion 56 mounted to the upper portion 54 in position beneath the perforated belt 38. The upper portion 54 is formed with a rectangular shaped, apertured section 58 which allows the passage of ambient air therethrough into the interior of suction housing 52. The lower portion 56 of suction housing 52 has an outlet 62.

The suction device 16 also includes structure for creating a negative pressure or suction within the interior of suction housing 52 for purposes discussed below in connection with an explanation of the operation of apparatus 10. As depicted in the Figs., the outlet 62 of suction housing 52 is connected by a duct or conduit 64 to an inlet formed in the top wall 66 of a drum 68. This top wall 66 mounts a vacuum pump 70 having an exhaust duct or tube 72 connected to a collector bag 74. As described in more detail below, the vacuum pump 70 is effective to create a negative pressure within the suction housing 52 to assist in "cleaning" the paper strips 22 formed by shredder device 12.

As depicted on the righthand side of FIGS. 1 and 2, the sifter plate 18 is connected by a hinge 76 to the discharge end 42 of conveyor 14. The inlet end of sifter plate 18 mounts a cover 78 and its outlet end is connected to a pair of support arms 80, 82 which orient the discharge ramp 76 in a downwardly angled position from the discharge end 42 of conveyor 14 to the collection hopper 20.

Figure 5:
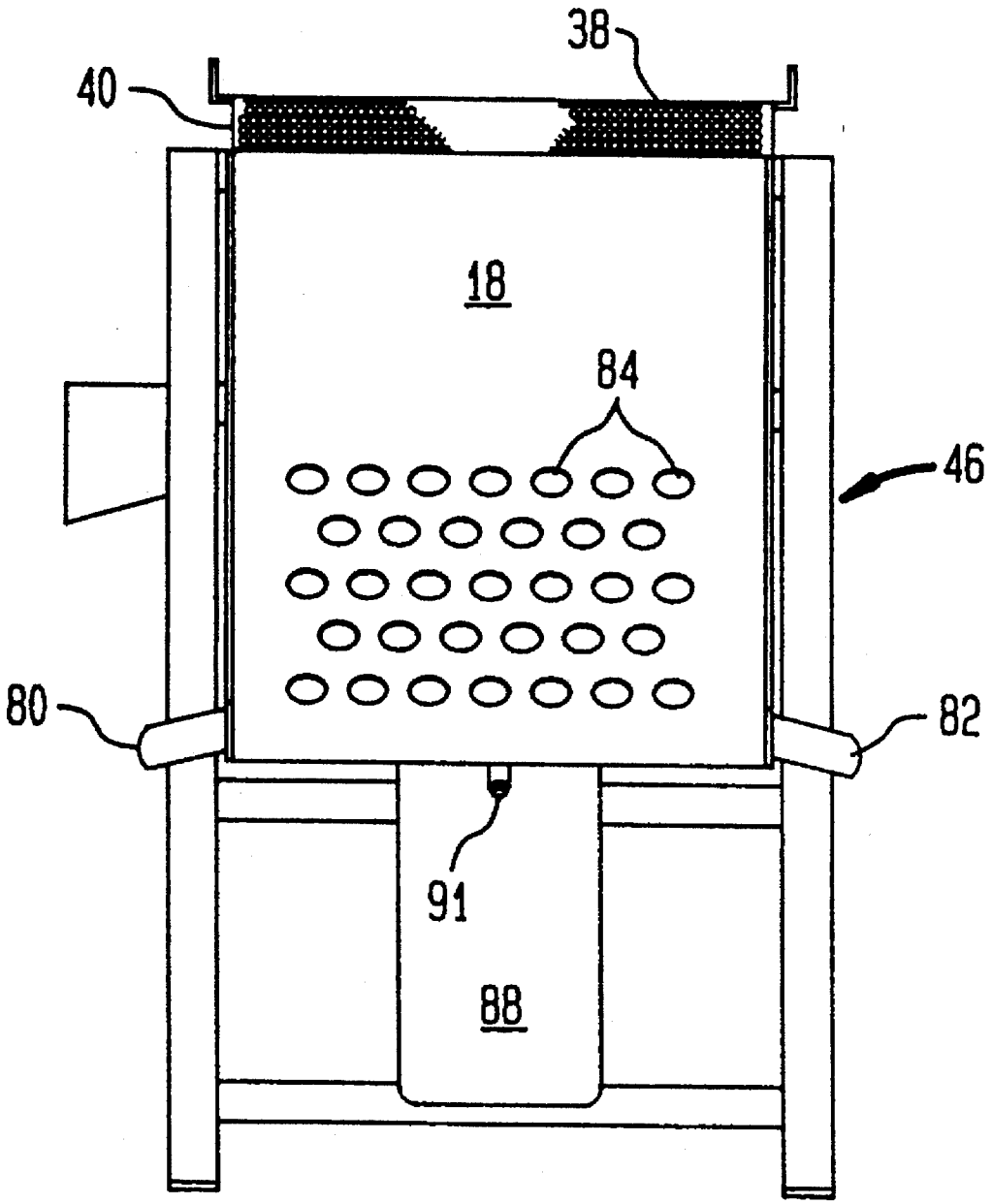
FIG. 5 is a view of the discharge end of the apparatus.

As shown in FIGS. 1, 34 and 5, the sifter plate 18 is formed with a number of openings 84 which are depicted as round in configuration but could be formed in other shapes. The largest cross section or diameter of the openings 84 is preferably on the order of about 1 inch to permit the passage of short material strips therethrough as discussed in more detail below. A waste hopper 86 is positioned beneath the sifter plate 18, immediately below the openings 84 therein.

In the presently preferred embodiment, a tank 88 filled with a liquid treatment material is located adjacent the waste hopper 86 beneath the discharge end 42 of conveyor 14. This tank 88 is connected by a hose 90 to a spray device such as a nozzle 91 which is effective to apply the liquid treatment material 94 within tank 88 onto the paper strips 22 as they fall into the collection hopper 20. Preferably, the liquid treatment material 94 within tank 88 has one or more of the following properties, i.e. microbicidal, sanitizing, insect repellant, disinfectant and deodorizing.

Operation of Apparatus

The operation of apparatus 10 proceeds as follows. It is contemplated that in many applications, corrugated cardboard from used shipping containers and the like will be utilized to form the paper strips 22 of this invention. Preferably, all staples, tape and any other foreign materials are removed from such corrugated boxes before being input to the shredder device 12.

As noted above, the shredder device 12 is effective to shred or cut the sheets of corrugated paper 26 to form elongated, thin paper strips 22. These paper strips 22 are emitted from the shredder device 12 onto the perforated belt 38 of conveyor 14. In the course of the shredding operation, a quantity of dirt, dust and the like is formed, some of which remains on the paper strips 22. In order to "clean" the paper strips 22, i.e. remove such unwanted dirt and dust, the suction device 16 is continuously operated. The vacuum pump 70 creates a negative pressure or suction through conduit 64 within the interior of suction housing 52. This suction creates a flow of ambient air from outside of the suction housing 52, through the apertured section 58 in its upper position 54 into the housing interior. Dust, dirt or other contaminants on or around the paper strips 22 are entrained within this air flow and drawn through the perforated belt 38 which supports the paper strips 22 after they are discharged from the shredder device 12. The air-entrained dirt and dust flows through conduit 64 into the drum 68, and then out its exhaust duct 72 into the collector bag 74 for disposal. Importantly, because the suction housing 52 is located at the outlet 28 of shredder device 12, little or no dust or dirt is allowed to escape to atmosphere, and the paper strips 22 are substantially cleaned before exiting the suction housing 52 and continuing along the conveyor 14 toward its discharge end 42.

Depending upon the shape of the corrugated paper sheets fed to the shredder device 12, there may be some instances in which shorter or irregular shaped material strips 92 are formed and deposited onto the conveyor 14. If these shorter material strips 92 are too large to pass through the perforated belt 38 under the application of suction within suction housing 52, they continue to move along the perforated belt 38 to its discharge end 42. In order to remove these shorter material strips 92 from the remaining paper strips 22, the apparatus 10 is provided with the sifter plate 18. All of the paper strips 22 and shorter material strips 92 are dumped onto the sifter plate 18 from the discharge end 42 of conveyor 14. The strips 22 and 92 slide by gravity along the sifter plate 18 over the openings 84 therein. The shorter or nonuniform sized material strips 92 pass through the openings 84 and fall by gravity into the waste hopper 86 where they are collected. These shorter material strips 92 are preferably saved and used in applications such as bedding for small animals. The remaining paper strips 22 continue on past the openings 84 in sifter plate 18 and are deposited into the collection hopper 20.

Preferably, as the paper strips 22 are leaving the sifter plate 18, or when they are first deposited in the collection hopper 20, liquid material 94 from the tank 88 is applied by the nozzle 91 onto the material strips 22. As noted above, this liquid 94 is environmentally safe and contains a number of properties such as microbicidal, sanitizing, insect repellant, disinfecting and deodorizing. In one presently preferred embodiment, the liquid material 94 has the following elements which are intermixed until uniform and deposited into tank 88:

| Material | % by Weight |
|---|---|
| Isopropyl alcohol 99% VWR | 40 |
| Oil of cederleaf | 0.2 |
| D Limonene | 1 |
| Nonoxynol - 12 | 5 |
| Water | 53.7 |
| BTC 2125 M50 | 0.1 |

Preferably, the liquid material 94 is sprayed onto the paper strips 22 in a fine mist from nozzle 91 so that a coating of less than about 1 millimeter in thickness is obtained thereon. As a result, the material strips 22 within collection hopper 20 are not only "cleaned" of any dust, dirt or other foreign materials, but are also coated with a protective liquid to make them more suitable for use as packing material.

While the invention has been described with reference to a preferred embodiment, it will be understood by those skilled in the art that various changes may be made and equivalence may be substituted for elements thereof without departing from the essential scope of the invention. In addition, many modifications may be made to adapt a particular situation or material to the teachings of the invention without departing from the essential scope thereof.

For example, the method and apparatus for "cleaning" the paper strips 22 is described above as including the application of a negative pressure within the suction housing 52 to draw a stream of ambient air therein within which dirt and dust from the paper strips 22 is entrained. It is also contemplated that a positive pressure could be introduced into suction housing 52 to generate an air flow to impinge against the paper strips 22 to dislodge and remove dust and dirt therefrom, although it is believed that a negative pressure is preferable to avoid dispersion of the dust and dirt.

Therefore, it is intended that the invention not be limited to the particular embodiment disclosed as the best mode contemplated for carrying out this invention, but that the invention will include all embodiments falling within the scope of the appended claims.

We claim:

1. Packing material for use in shipping items within containers, comprising:

a plurality of thin, elongated paper strips formed from sheets of corrugated cardboard;

said paper strips being substantially free of dust and dirt;

said paper strips being coated with a material having microbicidal, sanitizing, insect repellant, disinfecting and/or deodorizing properties.

2. The packing material of claim 1 in which said paper strips each have a length dimension in the range of about 2 to 24 inches, and a width dimension in the range of about ⅛ to ¼ inches.

3. The packing material of claim 1 in which each of said paper strips have a length dimension in the range of about 2 to 14 inches, and a width dimension of about ⅛ inch.

4. The packing material of claim 1 in which the material coating the material strips is a liquid which is applied onto the material strips in a thickness less than about 1 millimeter.

* * * * *